US005779204A

United States Patent [19]

Greenberg et al.

[11] Patent Number: 5,779,204

[45] Date of Patent: Jul. 14, 1998

[54] WORKSTATION FOR DOOR

[76] Inventors: Lee H. Greenberg, Rancho Shazam 14 Lucky Dr., Greenbrae, Calif. 94904; Manuel L. Karell, 3573-22 St., San Francisco, Calif. 94114

[21] Appl. No.: 574,205

[22] Filed: Dec. 18, 1995

[51] Int. Cl.[6] ..... A47B 96/06

[52] U.S. Cl. ..... 248/205.1; 248/225.21; 248/322; 248/339

[58] Field of Search ..... 248/205.1, 208, 248/211, 210, 215, 225.21, 314, 322, 339

[56] References Cited

U.S. PATENT DOCUMENTS 3,630,475 12/1971 Barry ..... 248/205.1 X 3,653,624 4/1972 Abel ..... 248/205.1 X 3,981,491 9/1976 Snyder ..... 269/64

5,226,623 7/1993 Hunt et al. ..... 248/211

*Primary Examiner*—Ramon O. Ramirez

[57] ABSTRACT

The Workstation for Door is a portable apparatus that interfaces between an open door and an item for the purpose of supporting the item in a stable elevated position. The Workstation for Door fits over the outer edge of a door(10) and slides downward until engaging and being supported by the door knob shafts(12). The face of the Workstation for Door has a variety of supporters or receptacles(14) for its many intended purposes. The Workstation for Door has a means to distance(20) an item from a door edge.

4 Claims, 6 Drawing Sheets

WORKSTATION FOR DOOR

BACKGROUND

1. Field of the Invention

The Workstation for Door generally relates to household items, particularly to an apparatus for suspending an item onto a door edge.

2. Description of Prior Art

Doors have been use to support various items, for example, a clothes rack over top of door. Bicycle workstations are either attached permanently to the floor or are portable and are used to suspend a bicycle for assembly, service or repairs, such as illustrated in U.S. Pat. No. 3,981,491 to Snyder, 1976.

SUMMARY OF THE INVENTION

The Workstation for Door is a portable apparatus that interfaces between an open door edge and an item, fitting over the outer edge of a door and having a connector means for sliding downward until engaging and being supported by the door knob shafts. The opposite side from the connector means is a receiving means for receiving and supporting an item. The receiving means may be configured to hold and suspend various items onto a door edge. The Workstation for Door can suspend and support an item, such as a bicycle, in a stable, elevated position for assembly, repair or maintenance. The workstation for door has attached to its bottom portion a distancing means to distance the item from the door's edge. Thus not only is the item suspended onto a door edge, it is also kept a specified distance from the edge. For example, when it is used as a bicycle workstation, a specific distance away from the edge allows for the turning of the pedals. The distancing means is adjustable as is its attachment to the bottom portion of the apparatus. The Workstation for Door can be modified to accept a commercially available bicycle frame clamp, thereby obviating the standard bicycle workstation stand; it is smaller for storage and is more portable. The Workstation for Door is useful for holding various other items onto a door edge, such as a sign, or a bag for garbage; or it can be useful for "third hand assistance," such as stabilizing an ironing board. The Workstation for Door can be minimally configured to use standard "S" hooks for supporting an item on a door edge.

DETAILED DESCRIPTION OF THE PREFERRED EMBODIMENT

Referring to FIGS. 1–5, Workstation for Door is an apparatus which is placed onto a door edge using the doorknobs for support while at the same time having a means to receive or support an item. Workstation for Door comprises a body(10) having attached to its back portion a connector means(12) for connecting to doorknob shafts; and having attached to its front portion a receiving means(14) for receiving and supporting an item; and attached to its bottom portion a coupling means(26) for coupling to a distancing means(20). The distancing means(20) comprises a bar having two ends in which one end(22) wraps around a door's edge and in which the other end(24) wraps around an item. The distancing means comprises a first element(26) and a second element(26') wherein first element(26) telescopes into second element(26') and is therefore adjustable. The coupling means comprises a first element(20) and a second element(20') wherein first element(20) telescopes into second element(20') and is therefore adjustable.

Figure 1:
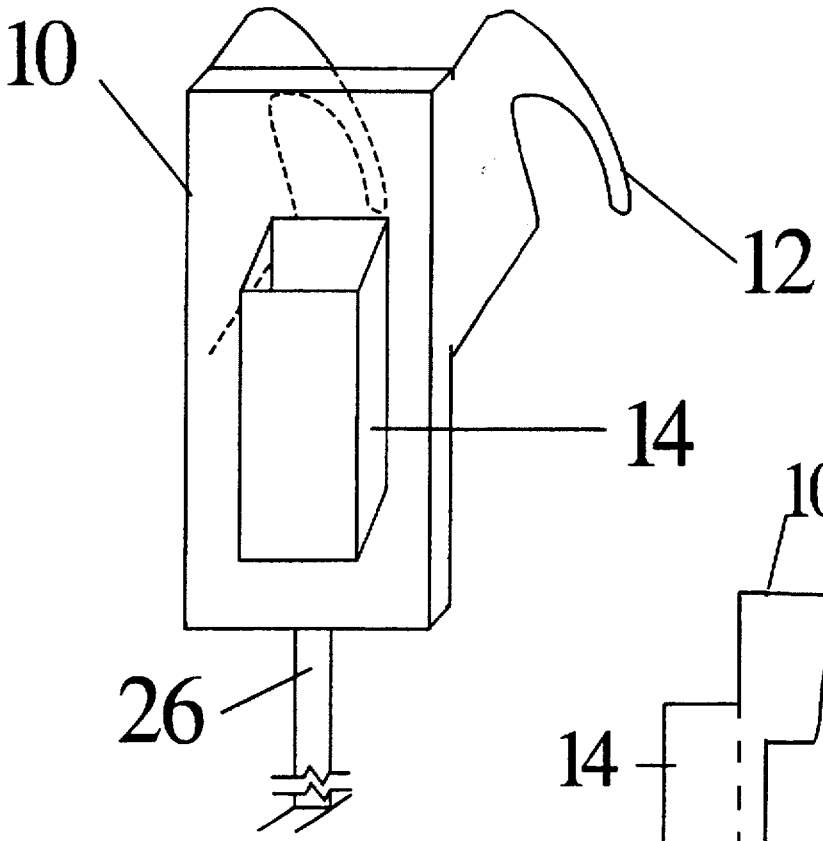
FIG. 1 is plano-perspective drawing of Workstation for Door showing a connector means for connecting to doorknob shafts and a receiving means for receiving and supporting an item.
Figure 1A:
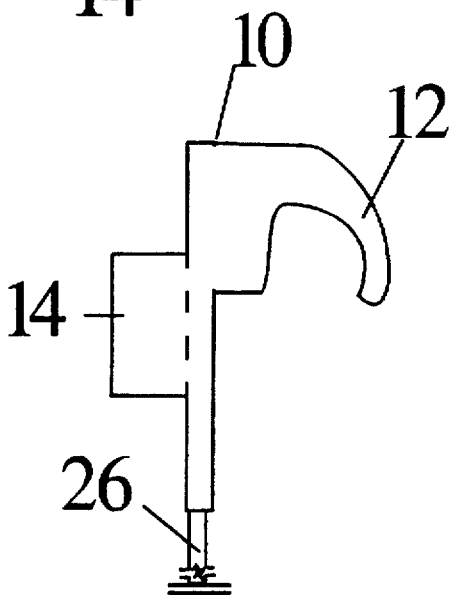
FIG. 1A is a side view drawing of Workstation for Door.
Figure 2:
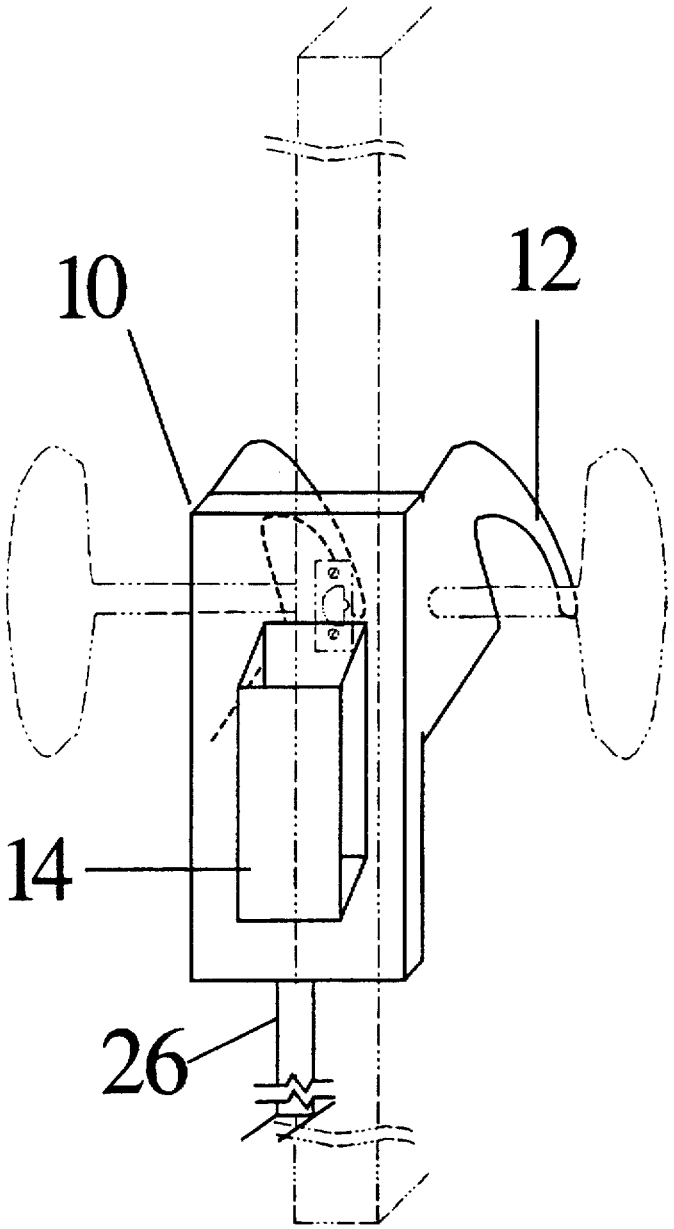
FIG. 2 is a schematic drawing of Workstation for Door fitting around door edge and onto doorknob shafts
Figure 3:
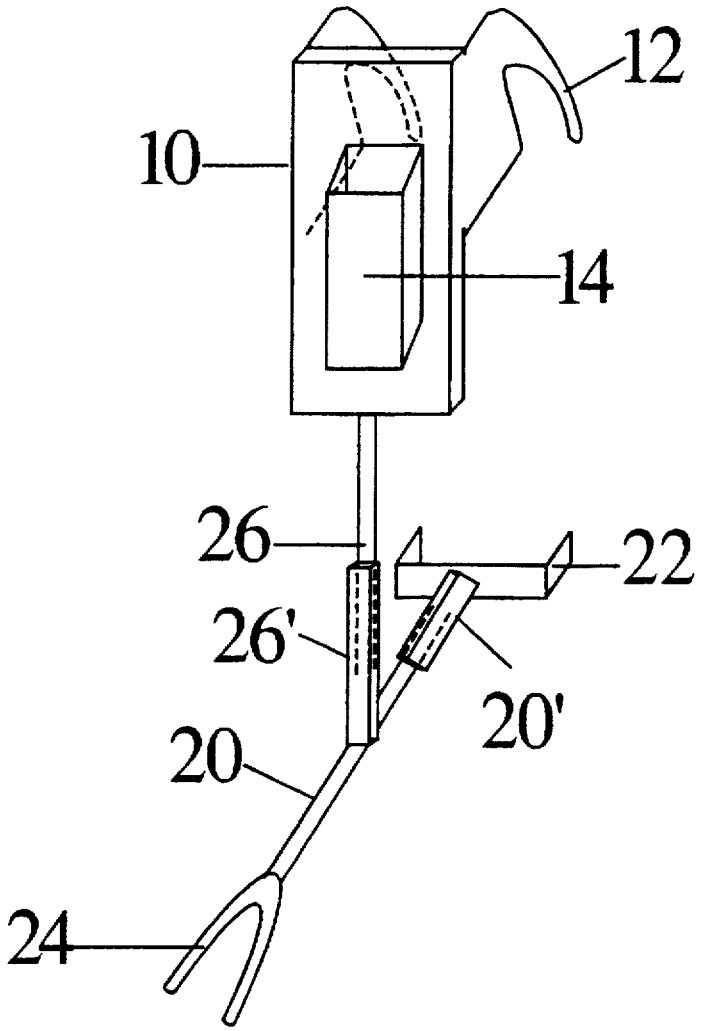
FIG. 3 shows an embodiment of Workstation for Door having connector means for connecting to doorknob shafts, receiving means for supporting an item, and distancing means for distancing an item from a door.
Figure 4:
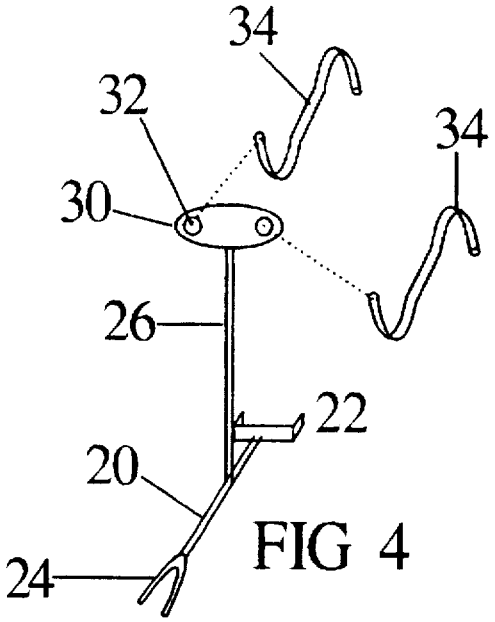
FIG. 4, 4A shows an alternative embodiment of Workstation for Door through which is inserted "S" hooks for connecting to doorknobs and for holding an item.
Figure 4A:
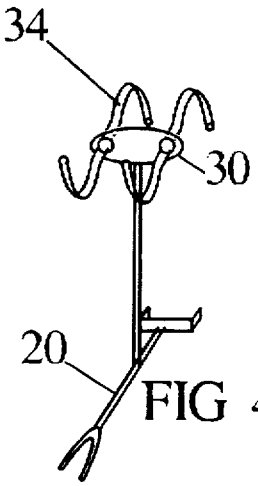
Figure 5:
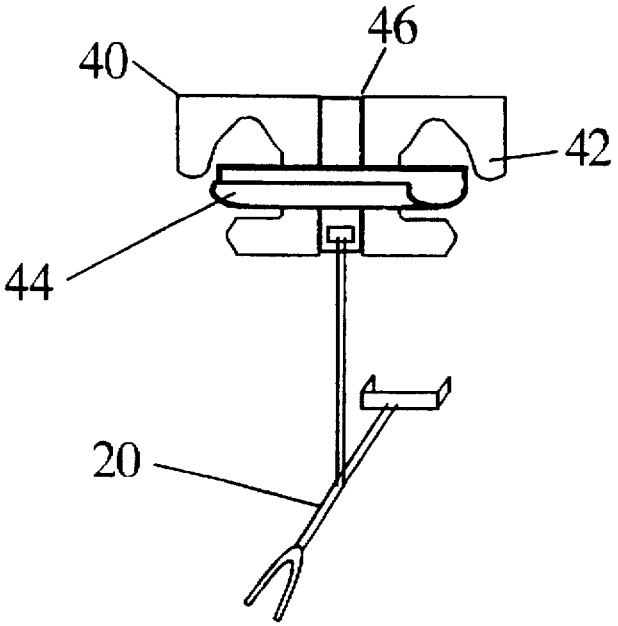
FIG. 5 shows an alternative embodiment of Workstation for Door in which a receiving means to hold an item is modified to support a bicycle frame member.

An alternative embodiment as seen in FIG. 4 wherein the body(30) now has holes(32) through which "S" hooks(32) pass for connecting to doorknob shafts and for receiving and supporting an item Another alternative embodiment seen in FIG. 5 is one in which the body is one piece(40) molded plastic with scoring(46) so that it can wrap around door edge and hook(42) around doorknob shafts, and in which a receiving means is modified to hold a bicycle frame member (40).

Figure 6A:
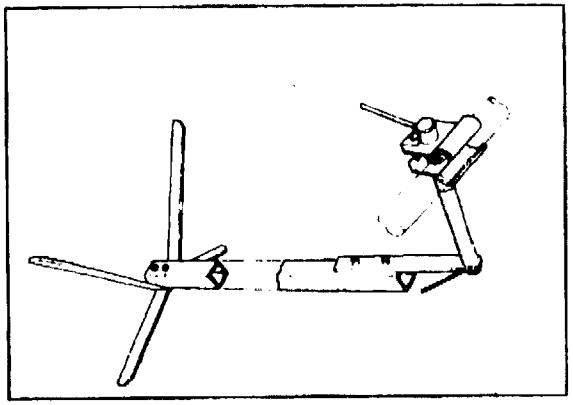
FIG 6A PRIOR ART
FIG. 6A shows prior art of bicycle workstation using a portable workstand support.
Figure 6:
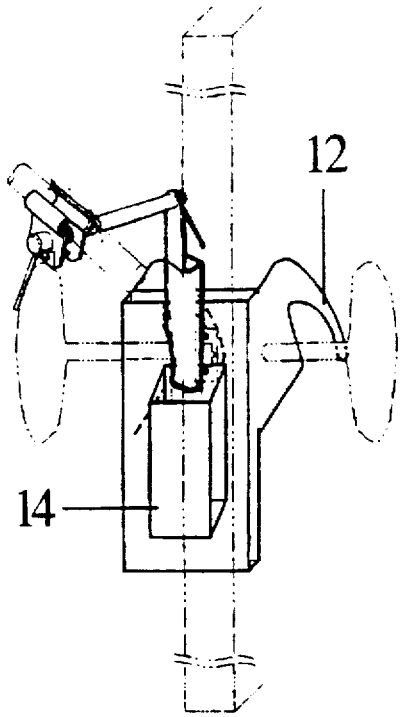
FIG. 6 shows Workstation for Door supporting a bicycle work station obviating need for workstation stand support
Figure 6B:
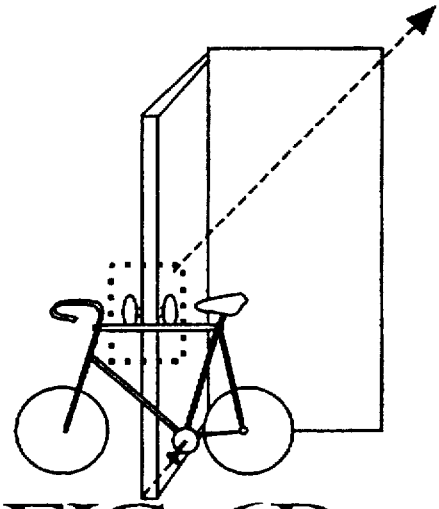
FIG. 6B shows schematic representation of Workstation for Door supporting a bicycle.

FIG. 6 shows prior art bicycle fame clamp (FIG. 6A) being inserted into a receiving means. FIG. 6B schematically shows a bicycle supported on door edge.

Figure 7B:
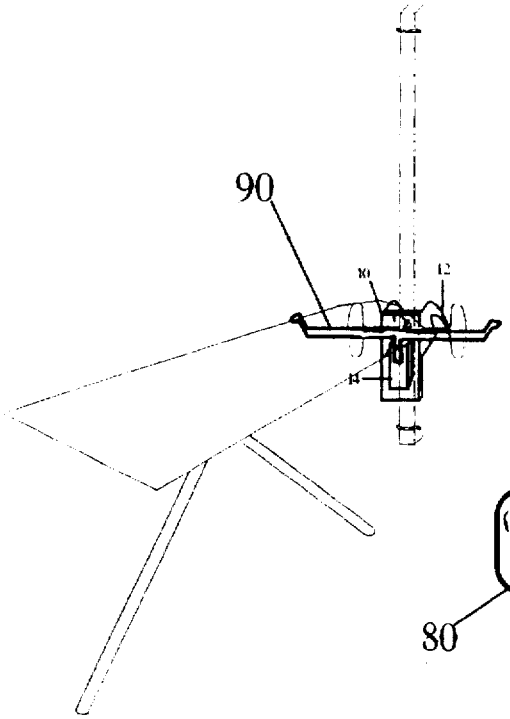
FIG. 7B shows Workstation for Door being used as a support for an ironing board.
Figure 7A:
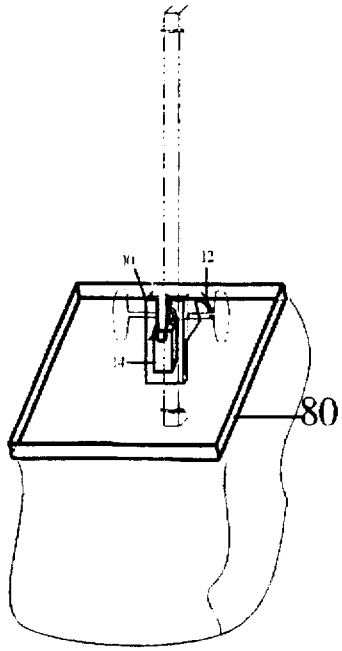
FIG. 7A shows Workstation for Door being used as a garbage bag holder.
Figure 7:
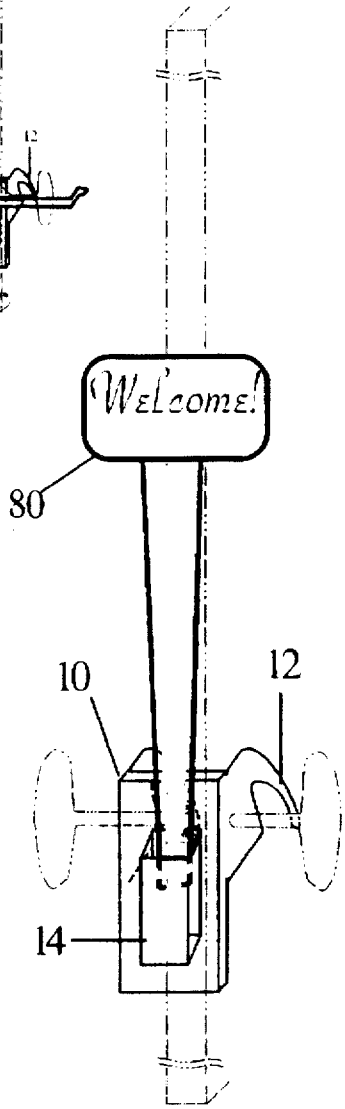
FIG. 7 shows Workstation for Door being used as a sign holder.

FIGS. 7, 7A, 7B are depictions of other uses of the instant invention.

While the use of a door to hold an item, for example a bicycle, is novel and the above description contains many specificities, these should not be considered as limitations on the scope of invention, but rather as exemplification's of preferred embodiments thereof Many other variations are possible, for example, a means to attach apparatus to door can be accomplished with the use of cable ties, and a means to hold bicycle to apparatus can be hooks. Accordingly, the scope of the invention should be determined not by the embodiments illustrated, but by the appended claims and their legal equivalencies.

We claim:

1. An apparatus placed between a door and an item for suspending the item onto the door's edge comprising:

a body having a front portion, a back portion, a top portion and a bottom portion;

a connector means attached to said back portion for connecting said body to doorknob shafts;

a receiving means attached to said front portion for receiving, supporting and suspending an item onto said body;

a distancing means for providing a distance between said item and said door's edge; and a coupling means for coupling said distancing means to said bottom portion.

2. The apparatus of claim 1 wherein said coupling means is adjustable for adjusting a length between said bottom portion and said distancing means.

3. The apparatus of claim 1 wherein said distancing means is adjustable for adjusting the distance of said item from said door's edge.

4. The apparatus of claim 1 wherein said distancing means comprises a bar having two ends wherein one end has a means to wrap around a door edge while the other end has a means to wrap around an item.

* * * * *